US007794340B2

(12) United States Patent
Mauer et al.

(10) Patent No.: US 7,794,340 B2
(45) Date of Patent: Sep. 14, 2010

(54) ADJUSTABLE LENGTH TRAINING BAT

(75) Inventors: Donald Mauer, St. Paul, MN (US); Gregory Knutson, St. Paul, MN (US); James Mauer, Minnetonka, MN (US)

(73) Assignee: Quickswing, Inc., St. Paul, MN (US)

( * ) Notice: Subject to any disclaimer, the term of this patent is extended or adjusted under 35 U.S.C. 154(b) by 624 days.

(21) Appl. No.: 11/626,291

(22) Filed: Jan. 23, 2007

(65) Prior Publication Data

US 2007/0173357 A1 Jul. 26, 2007

Related U.S. Application Data

(60) Provisional application No. 60/761,136, filed on Jan. 23, 2006.

(51) Int. Cl.
*A63B 69/00* (2006.01)
*A63B 59/00* (2006.01)

(52) U.S. Cl. ..... 473/457; 473/422; 473/437

(58) Field of Classification Search ..... 473/422, 473/431, 451, 457, 48, 239, 306, 307, 437, 473/453, 564–568, 552, 231, 234, 256
See application file for complete search history.

(56) References Cited

U.S. PATENT DOCUMENTS 1,943,066 A * 1/1934 Ford ..... 473/239
4,214,751 A 7/1980 Simpson
4,641,838 A 2/1987 Gabrielidis
4,674,747 A 6/1987 Mazzocco et al.
4,819,935 A 4/1989 Dirksing et al.
5,282,619 A 2/1994 Napolitano et al.
5,303,917 A 4/1994 Uke
5,316,306 A 5/1994 Cody
D363,519 S * 10/1995 Gooden ..... D21/734
5,628,691 A 5/1997 Shaner
5,634,856 A * 6/1997 Rainey ..... 473/234
5,799,937 A 9/1998 Nolan
6,623,372 B1 * 9/2003 Beebe et al. ..... 473/231
6,918,843 B1 7/2005 Franssen
6,949,036 B2 * 9/2005 Ciesar et al. ..... 473/457
7,578,747 B2 * 8/2009 Reilly ..... 473/219
2004/0038758 A1 2/2004 Guenther
2004/0063520 A1 4/2004 Mabry
2004/0245762 A1 12/2004 Joseph et al.
2005/0077741 A1 4/2005 Light
2007/0130714 A1 * 6/2007 Williams ..... 15/230.11
2007/0155525 A1 * 7/2007 Davenport et al. ..... 473/256

* cited by examiner

*Primary Examiner*—Mitra Aryanpour
(74) *Attorney, Agent, or Firm*—Dicke, Billig & Czaja, PLLC

(57) ABSTRACT

A training bat includes an elongated handle, an elongated barrel and a locking mechanism. The handle and the barrel are coupled together in a longitudinally adjustable manner such that an overall length of the training bat as defined by the handle and the barrel is adjustable. The barrel including a hitting portion configured to contact a ball during use. The locking mechanism is configured to lock the handle in a longitudinal position relative to the barrel by twisting at least one of the handle and the barrel relative to the other of the handle and the barrel in a first direction and to unlock the handle by twisting the at least one of the handle and the barrel relative to the other of the handle and the barrel in a second direction opposite the first direction.

17 Claims, 6 Drawing Sheets

ADJUSTABLE LENGTH TRAINING BAT

CROSS-REFERENCE TO RELATED APPLICATIONS

This patent application claims priority under 35 U.S.C. §119(e) to U.S. Provisional Patent Application Ser. No. 60/761,136 entitled "ADJUSTABLE LENGTH TRAINING BAT," having a filing date of Jan. 23, 2006, the contents of which are incorporated herein by reference.

BACKGROUND

In order to improve hand-eye coordination when hitting a baseball or softball with a bat, baseball and softball players typically spend many hours in batting practice. Bats configured to aid training and practice are useful in focusing the attention of the player on particular skill sets required to become a better hitter. Conventional training and general baseball and softball bats are available in a variety of lengths and weights for players of various strengths, abilities, and general preferences. For instance, a young or relatively weak player typically uses a lighter weight and/or shorter bat than a more experienced and/or stronger player. Accordingly, the number of bats and, therefore, the total costs of those bats, undesirably increases when a plurality of players of different abilities and preferences require training.

For these and other reasons there is a need for the present invention.

SUMMARY

One embodiment provides a training bat including an elongated handle, an elongated barrel and a locking mechanism. The handle and the barrel are coupled together in a longitudinally adjustable manner such that an overall length of the training bat as defined by the handle and the barrel is adjustable. The barrel including a hitting portion configured to contact a ball during use. The locking mechanism is configured to lock the handle in a longitudinal position relative to the barrel by twisting at least one of the handle and the barrel relative to the other of the handle and the barrel in a first direction and to unlock the handle by twisting the at least one of the handle and the barrel relative to the other of the handle and the barrel in a second direction opposite the first direction. Other embodiments and related methods are also disclosed.

DETAILED DESCRIPTION

In the following Detailed Description, reference is made to the accompanying drawings which form a part hereof, and in which is shown by way of illustration specific embodiments in which the invention may be practiced. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
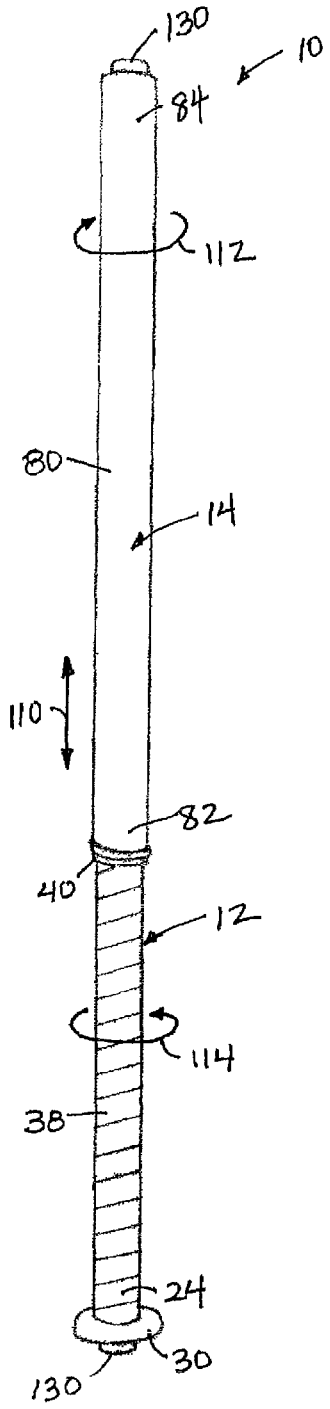
FIG. 1 illustrates a side view of one embodiment of a training bat in a shortened position.

One embodiment of a training bat 10 is generally illustrated in FIG. 1. Training bat 10 is configured for use by baseball or softball players training to improve their batting techniques. More specifically, training bat 10 is adjustable to permit the overall length of training bat 10 to be lengthened and shorten based on the strength, ability, and/or personal preference of the batter. For instance, the same training bat 10 can be used for a first player who generally uses a relatively short bat and a second player who generally uses a relatively long bat.

In one embodiment, training bat 10 includes a first member or internal shaft 12 and a second member or sleeve 14 telescopically coupled together in a longitudinally adjustable manner such that an overall length of training bat 10 as collectively defined by internal shaft 12 and sleeve 14 is adjustable. In one example, internal shaft 12 defines a handle of training bat 10, and sleeve 14 defines a barrel with a hitting portion of training bat 10. However, it should be understood that in other examples, internal shaft 12 defines the hitting portion of training bat 10, and sleeve 14 defines the handle of training bat 10. Internal shaft 12 and sleeve 14 are both substantially cylindrical, and sleeve 14 is generally sized to telescopically receive internal shaft 12. A longitudinal position of internal shaft 12 with respect to sleeve 14 is adjustable between a first, shortened position (e.g., as illustrated in FIG. 1) and a plurality of extended positions (e.g., the extended position of FIG. 2). Internal shaft 12 and sleeve 14 are formed of any suitable material, such as aluminum, steel, etc.

In one example, training bat 10 is adjustable to a plurality of overall lengths each similar to readily available lengths of game bats. For example, training bat 10 may be adjustable between overall lengths of between twenty-four inches to thirty-six inches. Accordingly, in one embodiment, internal shaft 12 includes indicia or a plurality of demarcations 16 (FIG. 2), indicating the position of sleeve 14 over internal shaft 12 that corresponds with overall bat lengths, for example, in two inch increments, such as 24", 26", 28", 30", 32", 34", and 36". Other indicia or demarcations may also be included on training bat 10 as will be apparent to those of skill in the art upon reading this application.

In one embodiment, training bat 10 includes a locking mechanism 18 configured to lock internal shaft 12 in a longitudinal position relative to sleeve 14 by twisting at least one of internal shaft 12 and sleeve 14 relative to the other of the internal shaft 12 and sleeve 14 in a first direction and to unlock internal shaft 12 by twisting the at least one of internal shaft 12 and sleeve 14 relative to the other of internal shaft 12 and sleeve 14 in a second direction opposite the first direction. In general, locking mechanism 18 can lock training bat 10 at any of adjustable overall lengths and is not dependent upon predetermined settings, etc.

Figure 3:
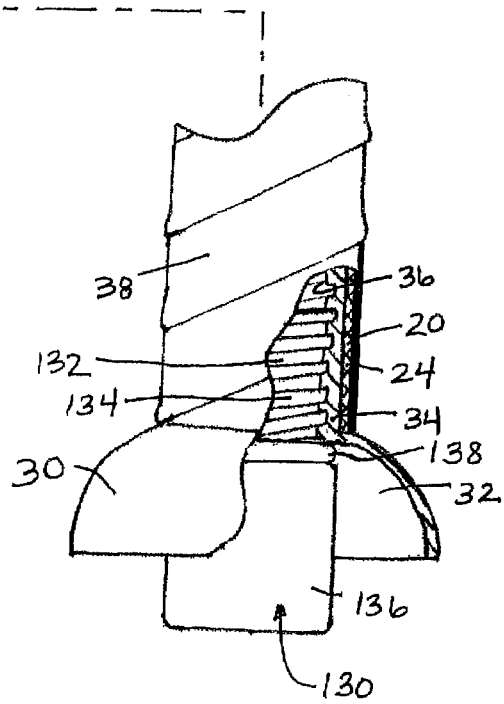
FIG. 3 illustrates an exploded side view of one embodiment of a barrel of the training bat of FIG. 1.

Additionally referring to the exploded internal shaft 12 side view of FIG. 3, in one embodiment, internal shaft 12 includes an elongated, tubular cylinder 20. In one embodiment, cylinder 20 defines an outer diameter similar to or smaller than that of a conventional bat handle. In one example, cylinder 20 defines a consistent outer diameter of approximately 0.75 inch. Cylinder 20 defines a first end 24 and a second end 26 longitudinally opposite first end 24. Where internal shaft 12 is a handle, a knob 30 is optionally coupled to first end 24 of training bat 10. In one example, knob 30 is formed separately from cylinder 20 and is coupled thereto with welding, adhesive, or any other suitable means. Referring to FIG. 3, in one embodiment, knob 30 includes primary portion 32 and a tubular portion 34 axially aligned with and extending from primary portion 32. Tubular portion 34 is sized to fit within an internal cavity 35 defined by cylinder 20 at first end 24 and is coupled thereto. In one embodiment, an internal surface 36 of tubular portion 34 is threaded to receive a corresponding threaded member as will be further described below. In other embodiments, knob 30 may be a solid or capped member.

Figure 2:
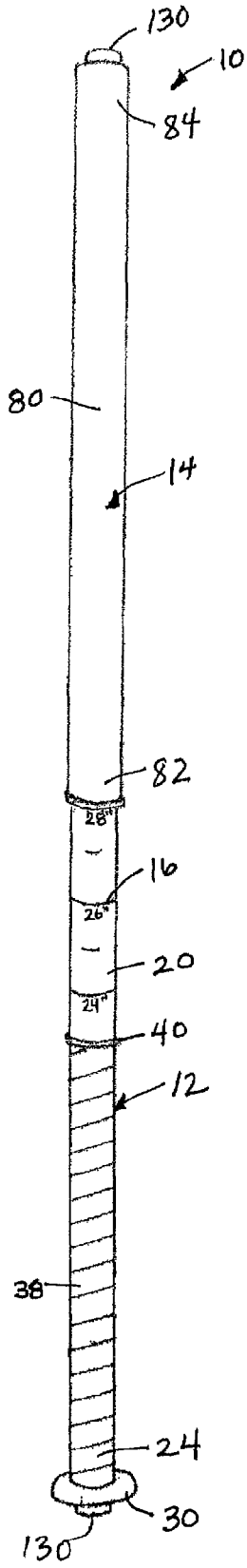
FIG. 2 illustrates a side view of one embodiment of the training bat of FIG. 1 in a partially extended position.
Figure 4:
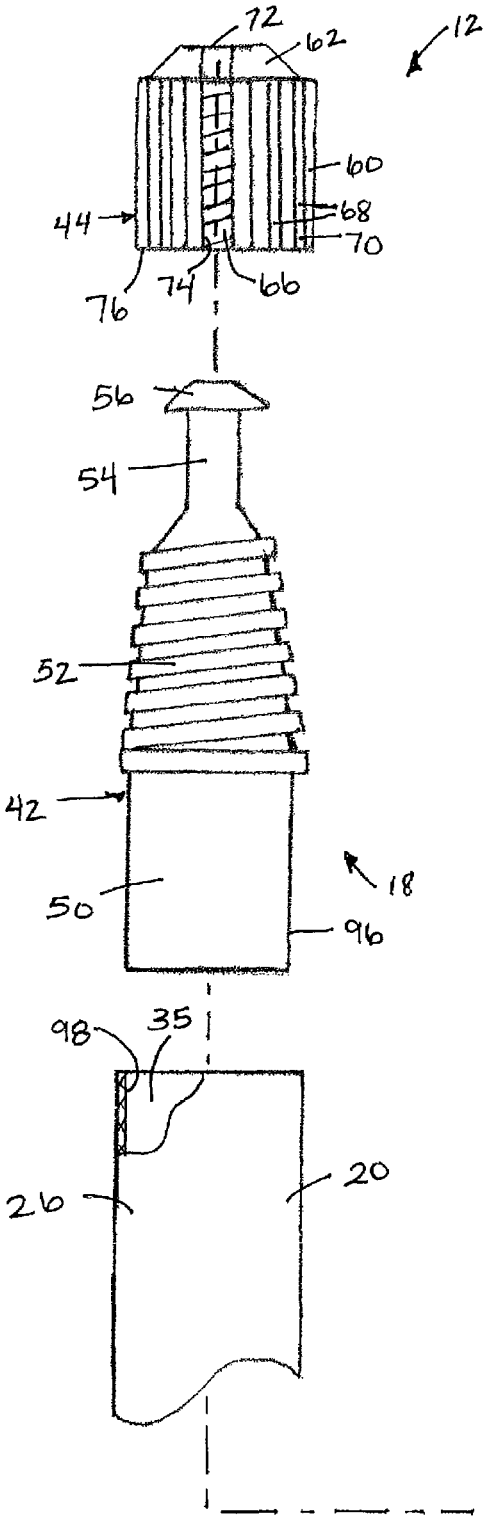
FIG. 4 illustrates a top view of one embodiment of a locking cuff of the barrel of FIG. 3.
Figure 4:
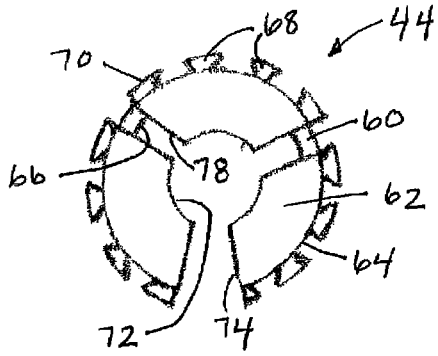

In one embodiment, internal shaft 12 includes a wrap 38 of any suitable material to insulate the hands of the player from the vibration of training bat 10 and/or to improve the grip of the player on training bat 10. For example, wrap 38 may be a rubber or rubber-like tape wrapped around cylinder 20 near first end 24 thereof. In one example, wrap 38 extends around cylinder 20 from first end 24 toward second end 26 thereby covering between one-third and one-half of a length of cylinder 20. Referring to FIGS. 1 and 2, in one embodiment, a collar 40 extends around cylinder 20 and is positioned substantially adjacent wrap 38 opposite knob 30. Collar 40 has a greater outer diameter than cylinder 20 and is configured to act as a stop for sleeve 14 as will be further described below. Other stops may additionally or alternatively be formed by internal shaft 12 and/or sleeve 14, such as, for example, within sleeve 14, as will be apparent to those of skill in the art upon reading this application.

In one embodiment, locking mechanism 18 of internal shaft 12 is coupled with second end 26 of cylinder 20. Locking mechanism 18 includes a spindle 42 and a cuff 44. Spindle 42 is coupled with second end 26 of cylinder 20, and cuff 44 is positioned around and configured to interact with spindle 42. More specifically, spindle 42 includes a coupling portion 50, an intermediate portion 52, a neck 54, and a stop 56. Coupling portion 50 is substantially cylindrical is sized with an outer diameter to fit into internal cavity of cylinder 20 at second end 26 thereof. In one embodiment, coupling portion 50 is secured to second end 26 of cylinder by friction fit, teeth of cylinder 20, adhesive, or other suitable agent. Notably, although generally described as being hollow, in one embodiment, cylinder 20 is substantially solid and is hollow near first and second ends 24 and 26 to accommodate attachment of knob 30 and/or locking mechanism 18.

Intermediate portion 52 extends from coupling portion 50 and away from second end 26 of cylinder 20. Near coupling portion 50, intermediate portion 52 has an outer diameter larger than the outer diameter of coupling portion 50 such that, when spindle 42 is slid into cylinder 20, intermediate portion 52 acts as a stop generally preventing movement of intermediate portion 52 into cylinder 20. Intermediate portion 52 is threaded and tapers as it extends away from coupling portion 50. Neck 54 is generally cylindrical and extends from intermediate portion 52 opposite and away from coupling portion 50. In general, neck 54 is significantly smaller in diameter than other portions of spindle 42. Neck 54 is capped by stop 56, which has a larger outside diameter than neck 54. In one embodiment, spindle 42 is formed of a single piece of material, such as, for example, injection molded plastic, or other suitably formed material.

Cuff 44 of locking mechanism 18 includes a substantially cylindrical portion 60 and a tapered portion 62 such that cuff 44 is configured to and does threadably engage spindle 42. Cylindrical portion 60 defines an outside surface 64 and an inside surface 66. A plurality of longitudinal ribs 68 radially extend outwardly from and are circumferentially spaced from one another around outside surface 64 of cuff 44. Each rib 68 defines an outside surface 70 at a radially outermost portion thereof. Inside surface 66 of cylindrical portion 60 is threaded and configured to selectively receive threaded, intermediate portion 52 of spindle 42. Tapered portion 62 extends away from an end of cylindrical portion 60 and is tapered toward a center opening 72. Center opening 72 is substantially circular and is sized to fit around neck 54 of spindle 42.

In one embodiment, a slot 74 is formed longitudinally formed in cuff 44 and extends from center opening 72 to an opposite longitudinal end 76 thereof. Slot 74 facilitates deformation of cuff 44 for assembly and during use of training bat 10 as will be further described below. In one embodiment, one or more other cutouts 78 are formed in cuff 44, more particularly, in at least tapered portion 62 so as to allow deformation of tapered portion 62 to increase the overall diameter of center opening 72 when appropriate pressure is applied to cuff 44 as will be further described below. In one embodiment, cuff 44 is formed of any suitable material such as plastic, and has a bias or elastomeric nature such that when stretched or deformed under external forces, cuff 44 will substantially return to its original shape and size.

During assembly of internal shaft 12, cuff 44 is placed around a portion of spindle 42. For example, cuff 44 is placed such that center opening 72 receives neck 54 and threaded inside surface 66 of cuff 44 interfaces with a portion of threaded, intermediate portion 52 of spindle 42 nearest neck 54 (see, e.g., FIG. 6). Notably, when initially placed around neck 54, cuff 44 is in a substantially un-stretched state such that the outer inside diameter defined by inside surface 66 is sufficiently small to generally prevent cuff 44 from longitudinally sliding over the entirety of intermediate portion 52 in the absence of additional forces.

Figure 5:
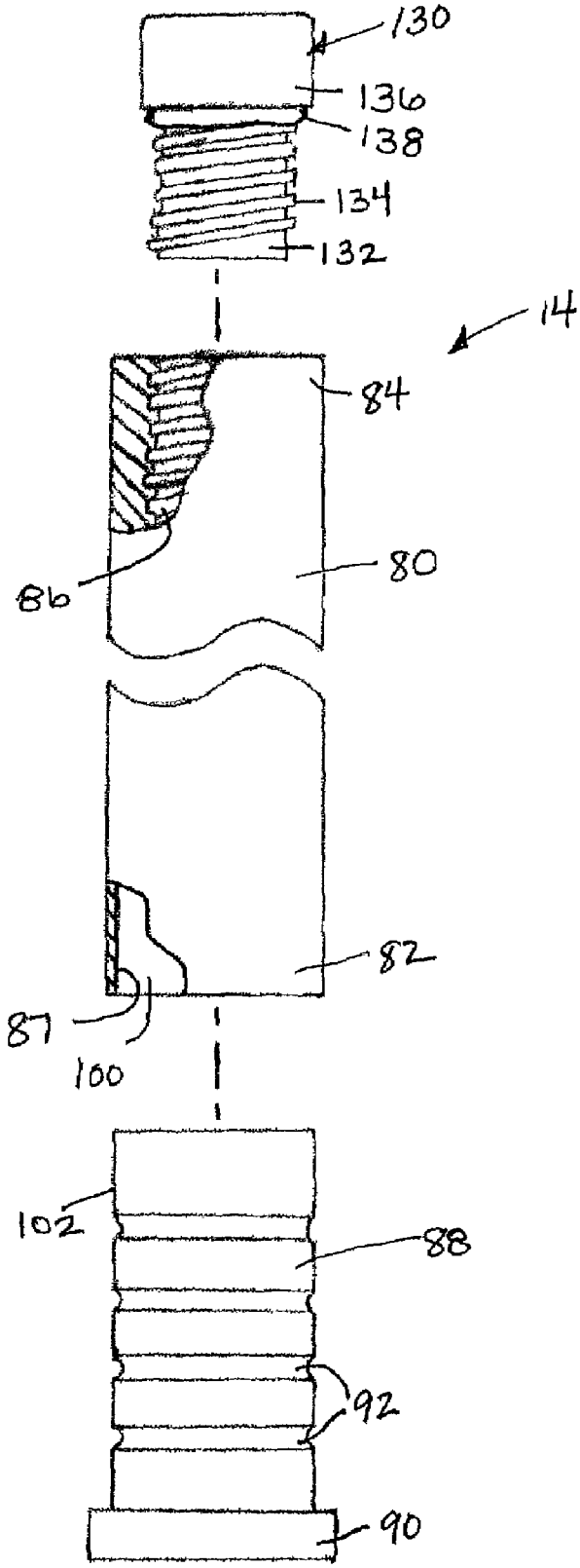
FIG. 5 illustrates an exploded side view of one embodiment of a sleeve of the training bat of FIG. 1.

FIG. 5 is an exploded illustration of sleeve 14 including a elongated cylindrical member 80 defining a first end 82 and a second end 84 longitudinally opposite first end 82. Cylindrical member 80 is generally hollow. In one embodiment, at least partially serves as a hitting portion of sleeve configured to contact a ball during training exercise. In one example, cylindrical member 80 defines a consistent outer diameter generally smaller than the typical outer diameter of a bat to facilitate an increase the concentration and accuracy of a batter attempting to hit a ball with training bat 10. In one example, outer diameter of sleeve 14 is less than two inches, for example, substantially equal to one inch. In one embodiment, second end 84 defines a threaded portion 86 of an inside surface 87 thereof configured to receive a corresponding threaded component. In one example, sleeve 14 includes a sheath 88 coupled with first end 82 of cylindrical member 80. Sheath 88 is a substantially cylindrical tube and includes a ring 90 extending outwardly around one longitudinal end thereof. In one embodiment, sheath 88 fits into hollow first end 82 of cylindrical member 80. Sheath 88 defines an inside diameter (not shown) just larger than the outer diameter of cylinder 20 of internal shaft 12. In one embodiment, sheath 88 defines a plurality of longitudinally spaced circumferential detents 92 each extending radially inward therefrom. Sheath 88 is formed of any suitable material, such as plastic, and is configured to slidably interface with internal shaft 12 as will further be described below.

Figure 8:
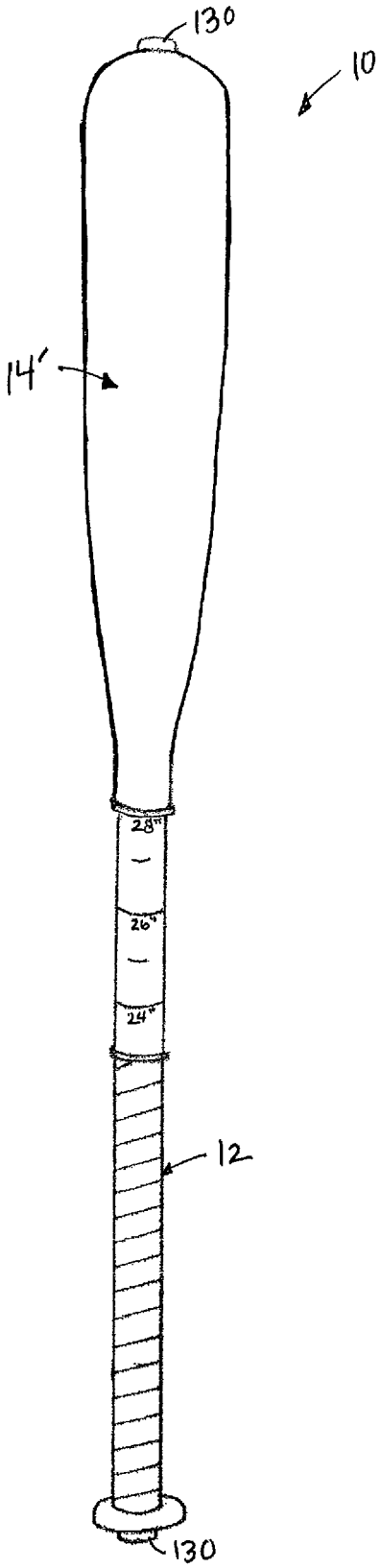
FIG. 8 illustrates a side view of one embodiment of a training bat.
Figure 9:
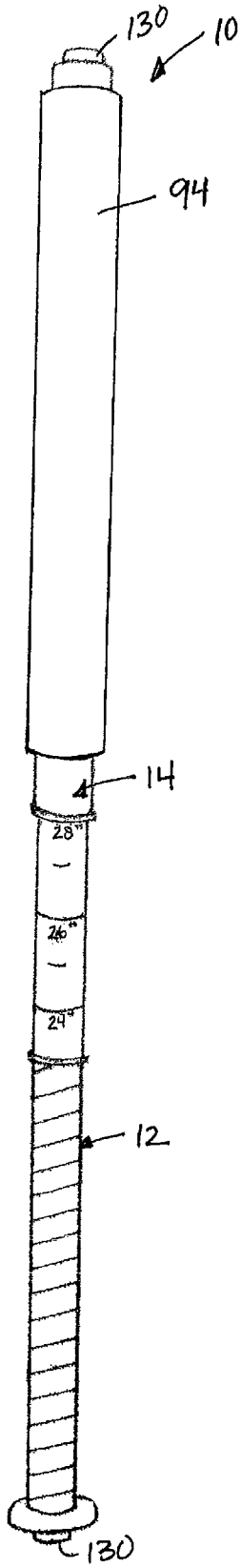
FIG. 9 illustrates a side view of one embodiment of a training bat with an impact absorption member.

Although primarily shown and described herein as being of constant diameter and a forming the outer surface configured to contact balls during batter training, other embodiments of sleeve 14 will be apparent to those of skill in the art upon reading this application. For example, sleeve 14 may define an outer shape more similar to that of a conventional bat as generally indicated as sleeve 14' as illustrated in FIG. 8 and/or may additionally including an outer casing or other impact absorption member 94 wrapped around at least a portion of sleeve and configured to absorb shock created when a ball or other object is contacted with training bat 10 and/or to adjust the overall outer diameter of training bat 10 as illustrated in FIG. 9. In one embodiment, outer casing 94 may additionally be configured to adjust the overall weight of training bat 10. Other alternatives, additions, etc. will also be apparent to those of skill in the art upon reading this application.

Referring to FIGS. 1, 2, 5, 6 and 7, internal shaft 12 and sleeve 14 are coupled to one another such that internal shaft 12 and sleeve 14 are rotatably and slidably adjustable relative to one another. In particular, in one example, during assembly, sheath 88 of sleeve 14 is placed around cylinder 20 near second end 26 such that ring 90 is relatively nearer first end 24 of cylinder 20 as compared to a remainder of sheath 88. As briefly described above, sheath 88 is sized to slidably move along cylinder 20. Following placement of sheath 88 on cylinder 20, spindle 42 is coupled with second end 26 of cylinder (i.e. to form a second end of internal shaft 12) as described with respect to FIG. 3 and cuff 44 is placed over spindle 42. In one example, when coupled, an outside surface 96 of coupling portion directly interfaces with inside surface 98 of cylinder 20 to at least partially couple spindle 42 to cylinder 20 via a friction fit.

Figure 6:
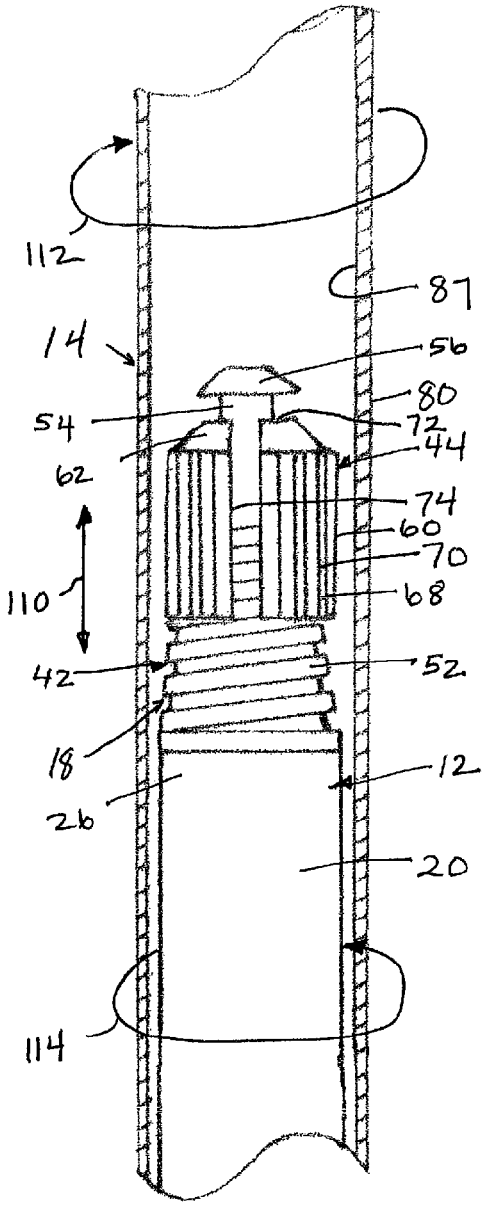
FIG. 6 illustrates a side view of one embodiment of a portion of the training bat of FIG. 1 in an unlocked state with half of the sleeve cut away for illustrative purposes.
Figure 7:
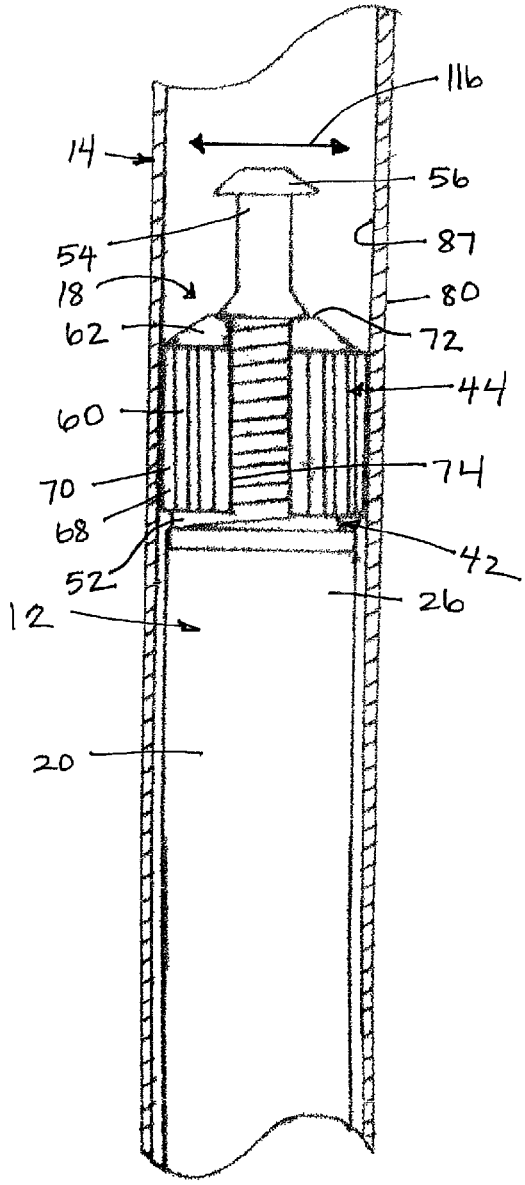
FIG. 7 illustrates a side view of one embodiment of a portion of the training bat of FIG. 1 in a locked state with half of the sleeve cut away for illustrative purposes.

Subsequently, first end 82 of cylindrical member 80 (i.e., a first end of sleeve 14) is slid over locking mechanism 18 and second end 26 of cylinder 20 and into contact with sheath 88. More specifically, a portion of sheath 88 is received within an internal cavity 100 of cylindrical member 80 such that inside surface 87 of cylindrical member 80 directly interfaces with an outside surface 102 of sheath 88 to form a friction-fit coupling. The coupling may be strengthened or otherwise formed with adhesive or other suitable means. As illustrated in FIG. 6, which is shown with half of sleeve 14 removed for illustrative purposes, internal shaft 12 is able to slide into sleeve 14 as the outer diameters of cylinder 20, spindle 42, cuff 44 are smaller than the inside diameter of sleeve 14, more particularly, of cylinder member 80. Notably, in FIG. 6 the spacing between the outer surfaces of cylinder 20, spindle 42, cuff 44 and inside surface 87 of sleeve 14 is shown in an exaggerated fashion to more easily illustrate transition of locking mechanism 18 from an unlocked position (e.g., as shown in FIG. 6) to a locked position (e.g. as shown in FIG. 7). For example, in one embodiment the outer surfaces 70 of ribs 68 are substantially always in contact with inside surface 87 of sleeve 14.

In one embodiment, the outer diameter of intermediate portion 52 has a larger outer diameter than the outer diameter cylinder 20 and than of sheath 88. AS a results, intermediate portion 52 also functions as a stop that interacts with sheath 88 to generally prevent or at least decrease the likelihood of sleeve 14 being inadvertently removed from around internal shaft 12. In one embodiment, other stops suitably configured to prevent inadvertent uncoupling of internal shaft 12 and sleeve 14 are used in addition or as an alternative to the sizing of intermediate portion 52. In another embodiment, internal shaft 12 and sleeve 14 are configured to be selectively uncoupled from one another such that sleeves 14 of different diameters by be interchanged with one another on internal shaft 12. In this manner, the outside diameter of the hitting portion of training bat 10 can be changed as desired to further vary the training exercises of a batter and/or to provide a progression of hitting portion diameters for use in training to further develop the skills of the batter.

Upon assembly, locking mechanism 18 is initially in an unlocked position as illustrated in FIG. 6. During use, internal shaft 12 and sleeve 14 are longitudinally slid relative to one another, as generally indicated by arrow 110, into a desired position selected by a user. For example, sleeve 14 may be positioned to align with a particular demarcation 16 on internal shaft 12, such as the twenty-eight inch demarcation 16.

Once in the desired longitudinal position, internal shaft 12 is rotated or twisted in a clockwise direction relative to sleeve 14 and/or sleeve is rotated in a counter clockwise direction relative to internal shaft 12 as generally indicated by arrows 112 and 114, respectively. Such rotation in combination with the threads on inside surface 66 of cuff 44 and on intermediate portion 52 of spindle 42 causes cuff 44 to be moved toward cylinder 20 (e.g., toward first end 24 of cylinder 20). Due to the tapered configuration of spindle 42 as cuff 44 moves toward first end 24, cuff 44 is generally forced to widen (i.e. expand or stretch radially outward) as generally indicated by arrow 116 of FIG. 7. In one example, the widening of cuff 44 is facilitated by slot 74 defined therein. Further, cutouts 76 allow portions of tapered portion 62 to flex, thereby, increasing diameter of center opening 72 to move from around neck 54 to around intermediate portion 52 of spindle 42.

Widening of cuff 44 pushes outer surfaces 70 of ribs 68 into more robust interaction with inside surface 87 of sleeve 14 thereby, increasing the force of surface 70 on sleeve 14. As this interaction is strengthened by further widening of cuff 44 (caused by further rotation of internal shaft 12 relative to sleeve 14) to lock the position of cuff 44 with respect to inside surface, which, in turn, selectively locks internal shaft 12 in position relative to sleeve 14. In one embodiment, a portion of intermediate portion 52 is formed to prevent cuff 44 from advancing over and past intermediate portion 52 as internal shaft 12 continues to twist relative to sleeve 14. To unlock the position of internal shaft 12 relative to sleeve 14 to readjust the overall length of training bat 10, internal shaft 12 and sleeve 14 are rotated in directions opposite that generally indicated by arrows 112 and 114. Due to the tapered configuration of intermediate portion 52 of spindle 42, such rotation, moves cuff 44 back toward stop 56. More specifically, movement of cuff 44 toward stop 56 and the resilient or biased nature of cuff 44 results in cuff 44 returning to a smaller, un-stretched diameter (e.g. as shown in FIG. 6) with less force being placed on inside diameter of sleeve 14 from outer surfaces 70 of cuff 44.

Since the force between cuff 44 and sleeve 14 is lessened, internal shaft 12 and sleeve 14 can once again be slid longitudinally relative to one another. Stop 56 on neck 54 is configured to prevent or at least decrease the chances of cuff 44 sliding off of neck 54. As such, in one embodiment, stop 56 has an outer diameter larger than the diameter of center opening 72 in an un-stretched state. Given this functioning of locking mechanism 18 to lock and unlock the position of internal shaft 12 relative to sleeve 14, sleeve 14 and internal shaft 12 can be adjusted to any longitudinal position there along and twist-locked into place. In this manner, the possible locations of sleeve 14 relative to internal shaft 12 are fully selectable and are not limited to a few pre-selected longitudinal locations. Other suitable methods and structures of coupling internal shaft 12 with sleeve 14 permitting length adjustment of training bat 10 will be apparent to those of skill in the art upon reading this application.

Although primarily described above as positioning locking mechanism 18 within sleeve 14, in one embodiment, an additional or alternative locking mechanism is positioned outside sleeve 14.

Referring to FIGS. 1, 3, and 5, in one embodiment, weight plugs 130 are provided with or as an accessory to training bat 10. In one example, each weight plug 130 includes a shaft portion 132 with threads 134 and a knob or head 136. Shaft portion 132 and head 136 are coaxially aligned, and shaft portion 132 extends from head 136. Threads 134 of shaft portion 132 are configured to interface with threaded internal surface 36 of internal shaft 12 and/or threaded portion 86 of inside surface 87 of sleeve 14. In one embodiment, each weight plug 130 includes a resilient O-ring or other seal 138 positioned around shaft portion 132 adjacent head 136. Seal 138 limits the depth of insertion of each weight plug 130 into training bat 10 and/or limits undesirable rotational or longitudinal travel of weight plug 130 during use, which could otherwise eventually cause weight plug 130 to undesirably work its way out of training bat 10 during use.

In one embodiment, different weight plugs 130 have heads 136 of different sizes and/or shaft portions 132 of different lengths such that each weight plug 130 has a predetermined weight. In one example, weight plugs 130 are each formed of materials with different densities to vary the weigh of each weight plug 130. For example, weight plugs 130 may be available in various sizes including 1 oz., 2 oz., and 3 oz. In one embodiment, all weight plugs 130 have a similar diameter shaft portion 132 and threads 134 such that all weight plugs 130 can interchangeably be used with internal shaft 12 and sleeve 14. In one embodiment, a different set of weight plugs 130 may be provided for internal shaft 12 and sleeve 14 such that all weight plugs 130 are not generally interchangeable. In one embodiment, training bat 10 without any weight plugs 130 weighs between about 13 oz. and about 20 oz. such that addition of any weight plugs 130 increases the weight of training bat 10 over about 13 oz. and about 20 oz.

The threaded connection of weight plugs 130 allows weight plugs 130 to be selectively coupled with training bat 10 in an interchangeable manner. As such, use of weight plugs 130 can be altered as training needs change or evolve. Weight plugs 130 may be used for a variety of purposes including but not limited to simulation of the weight of a conventional game bat, alteration of a batter's swing, increasing strength of a batter's swing, etc. In one example, weight plugs 130 can alternatively or additionally be used to alter the center of gravity of training bat 10 and/or to otherwise affect the batter's swing in a desired manner.

Figure 10:
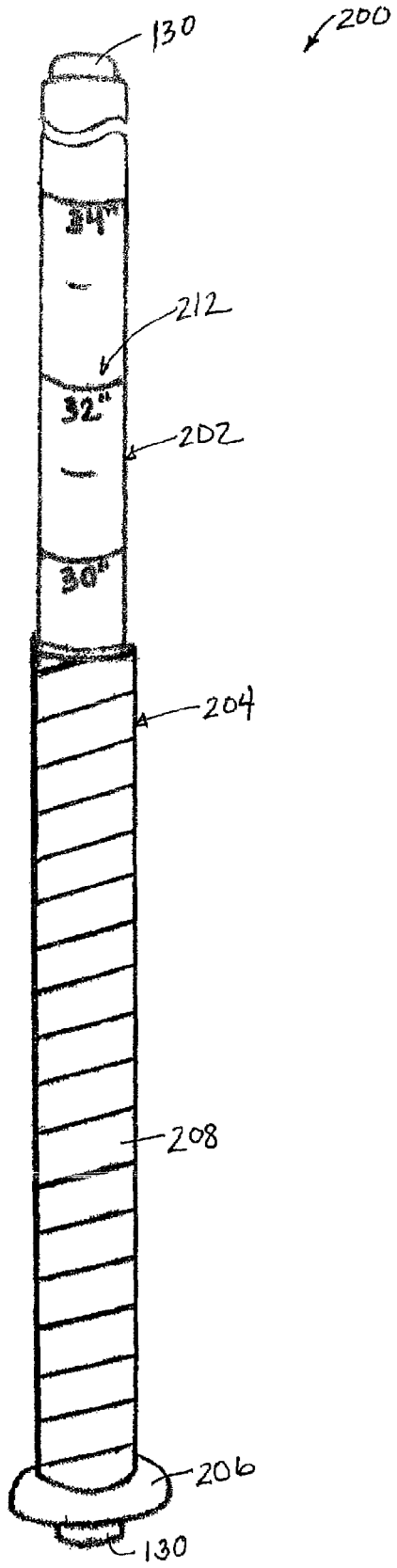
FIG. 10 illustrates a side view of one embodiment of a training bat.

Another embodiment of a training bat is generally indicated at 100 in the illustration of FIG. 10, training bat 200 includes a generally cylindrical internal shaft or barrel 202 telescopically received within a generally cylindrical sleeve 204 similar to training bat 10. However, barrel 202 serves as the hitting portion and sleeve 204 serves as the handle of training bat 200 (i.e. the opposite arrangement as primarily described with respect to training bat 10). Barrel 202 and sleeve 204 are configured to facilitate easily slidable, telescopic movement of barrel 202 within sleeve 204. In one embodiment, sleeve 204 is sized similar to a conventional bat handle conforming with standard baseball or softball bat size regulations. In one embodiment, sleeve 204 includes an end cap or knob 206 at an end opposite the extension of barrel 202. In one embodiment, each of barrel 202 and sleeve 204 are formed of aluminum, steel or other suitable material.

In one embodiment, sleeve 204 alternatively defines a smaller outer diameter than a conventional bat handle. In one example, sleeve 204 defines a consistent outer diameter of approximately 1 inch. In one example, sleeve 204 includes a wrap 208 of any suitable material to insulate the hands of the batter from the vibration of training bat 200 and/or to improve the grip of the batter on training bat 200.

Barrel 202 is one of hollow cylindrical and solid. Barrel 202 can be weighted as desired to emulate a conventional baseball or softball bat or to achieve any weight desirable for training a batter (i.e., barrel 202 may be weighted to produce an overall training bat 200 that weighs one of more than and less than a conventional bat). Barrel 202 is configured to contact balls during training. In one example, barrel 202 includes a cushion or other impact absorbing material, such as material 94 as described with respect to FIG. 9, positioned at and/or near a preferred hitting area of barrel 202 (i.e., an area of barrel preferred for hitting a ball).

In one embodiment, barrel 202 is formed with a constant outer diameter along the entire length of barrel 202. In one embodiment, barrel 202 may taper outward near the end of barrel 202 opposite sleeve 204. The position of barrel 202 within handle is adjustable. In particular, barrel 202 can be adjusted relative to sleeve 204 to vary the overall length of training bat 200.

In one embodiment, barrel 202 is locked at any one of a plurality of positions within sleeve 204 with any suitable locking mechanism, such as locking mechanism 18 described with respect to training bat 10 (FIGS. 1-7). In one example, the locking mechanism alternatively utilizes a elliptical stopper or cam near an end of barrel 202 positioned within sleeve 204, which defines an at least partially elliptical cavity therein. As such, when elliptical portion of barrel 202 is aligned with an elliptical portion of the sleeve cavity, barrel 202 can be adjusted to a desired length. When the desired length is achieved, barrel 202 is rotated or twisted relative to sleeve 204 or vice versa to misalign elliptical portion of barrel 202 with elliptical portion of the handle cavity. When the elliptical portions of barrel 202 and the sleeve cavity are misaligned, the position of barrel 202 relative to sleeve 204 is locked. Use of other suitable locking mechanisms, for example, a round stopper coupled with barrel 202 in a non-coaxial manner and placed within a round or elliptical handle cavity, is also contemplated.

In one embodiment, barrel 202 includes indicia 212 indicating the placement of an end of sleeve 204 relative to barrel 202 that corresponds with an overall length of training bat 200. In one example, indicia 212 are included in increments of two inches from about twenty-four inches to about thirty-six inches. While unlocked, barrel 202 is moved into or out of sleeve 204 to align sleeve 204 with an indicium 212 that corresponds with the desired overall length of training bat 200. For example, if a thirty-two inch training bat 200 is desired, sleeve 204 is aligned with the thirty-two inch indicium 212 on barrel 202. Once sleeve 204 is aligned with the appropriate indicium 212, barrel 202 and/or sleeve 204 are twisted to lock barrel 202 in position relative to sleeve 204. Accordingly, the length of training bat 200 can be adjusted for various sized users or for various training exercises without requiring the user to measure the length of training bat 200.

Although specific embodiments have been illustrated and described herein, it will be appreciated by those of ordinary skill in the art that a variety of alternate and/or equivalent implementations may be substituted for the specific embodiments shown and described without departing from the scope of the present invention. For example, the features of training bat 10 can be used in addition to or as an alternative to the features of training bat 200 and vice versa as will be apparent to those of skill in the art upon reading this application. Similarly, other features not specifically described herein but in the spirit of the present embodiments, will also be apparent to those of skill in the art upon reading this application. As such, this application is intended to cover any adaptations or variations of the specific embodiments discussed herein. Therefore, it is intended that this invention be limited only by the claims and the equivalents thereof.

What is claimed is:

1. A training bat comprising:

an elongated handle;

an elongated barrel, the handle and the barrel being coupled together in a longitudinally adjustable manner such that an overall length of the training bat defined by the handle and the barrel is adjustable, the barrel including a hitting portion configured to contact a ball during use; and a locking mechanism configured to lock the handle in a longitudinal position relative to the barrel by twisting at least one of the handle and the barrel relative to the other of the handle and the barrel in a first direction and to unlock the handle by twisting the at least one of the handle and the barrel relative to the other of the handle and the barrel in a second direction opposite the first direction, the locking mechanism comprising a spindle and a cuff configured to threadably engage the spindle;

wherein the overall length of the training bat defined by the handle and the barrel is adjustable to and configured to be locked at any overall length between 24 and 36 inches corresponding to a readily available length of a game bat.

2. The training bat of claim 1, wherein each of the barrel and the handle include an elongated, hollow, and substantially cylindrical member.

3. The training bat of claim 1, wherein the locking mechanism is coupled to a first end of the handle, the first end of the handle and the locking mechanism being received by and enclosed within the barrel.

4. The training bat of claim 3, wherein the spindle extends from a first end of the handle and defines a tapered and threaded portion.

5. The training bat of claim 3, wherein the handle includes a plurality of demarcations each corresponding to a readily available length of a game bat.

6. The training bat of claim 1, wherein at least one of the barrel and the handle includes a stop limiting longitudinal movement of the barrel relative to the handle.

7. The training bat of claim 1, in combination with a plurality of weighted plugs configured to be selectively coupled with at least one of the barrel and the handle.

8. The training bat of claim 1, wherein the hitting portion is substantially smaller in diameter than a hitting portion of a game bat to facilitate an improvement in hitting accuracy.

9. The training bat of claim 1, wherein the handle includes demarcations indicating longitudinal positions of the barrel relative to the handle that correspond with predetermined overall lengths of the training bat that are similar to readily available lengths of game bats.

10. The training bat of claim 1, wherein the hitting member of the has an outside diameter of less than two inches.

11. The training bat of claim 1, wherein each of the handle and the barrel are formed of steel.

12. A batting aid comprising:

means for hitting a ball including means for facilitating an improvement in hitting accuracy;

means for increasing grip of a user on the batting aid, the means for increasing grip being positioned substantially opposite and on a separate member than the means for hitting;

means for adjusting a longitudinal position of the means for hitting relative to the means for increasing grip;

means for twistably locking and unlocking the means for hitting in the longitudinal position relative to the means for increasing grip;

means for preventing movement of the means for hitting the ball over the means for increasing grip; and means for adjusting a weight of the batting aid.

13. The batting aid of claim 12, wherein the means for twistably locking is coupled to the means for increasing grip via a shaft; the means for twistably locking including threadable means for increasing a force applied to an internal surface of the means for hitting.

14. A training bat comprising:

an elongated handle;

an elongated barrel, the handle and the barrel being coupled together in a longitudinally adjustable manner such that an overall length of the training bat defined by the handle and the barrel is adjustable, the barrel including a hitting portion configured to contact a ball during use; and a locking mechanism configured to lock the handle in a longitudinal position relative to the barrel by twisting at least one of the handle and the barrel relative to the other of the handle and the barrel in a first direction and to unlock the handle by twisting the at least one of the handle and the barrel relative to the other of the handle and the barrel in a second direction opposite the first direction, wherein the locking mechanism is coupled to a first end of the handle, the first end of the handle and the locking mechanism being received by and enclosed within the barrel, wherein the locking mechanism includes a spindle and a cuff, the spindle extending from the first end of the handle and defining a tapered and threaded portion, the cuff being configured to threadably engage the spindle, wherein twisting the at least one of the handle and the barrel relative to the other of the handle and the barrel in the first direction causes the cuff to move on the tapered and threaded portion such that the overall diameter of the cuff is stretched thereby increasing a force the cuff applies to an inside surface of the barrel to lock the handle in a longitudinal position relative to the barrel, and wherein the handle includes a plurality of demarcations each corresponding, to a readily available length of a game bat.

15. The training bat of claim 14, in combination with a plurality of weighted plugs configured to be selectively coupled with at least one of the barrel and the handle.

16. The training bat of claim 14, wherein the hitting portion is substantially smaller in diameter than a hitting portion of a game bat to facilitate an improvement in hitting accuracy.

17. The training bat of claim 14, wherein at least one of the barrel and the handle includes a stop limiting longitudinal movement of the barrel relative to the handle.

* * * * *